United States Patent [19]

Chin-Song

[11] Patent Number: 4,974,139

[45] Date of Patent: Nov. 27, 1990

[54] DESK LAMP WITH IMPROVED ANGULAR POSITION ADJUSTING STRUCTURE

[76] Inventor: Chen Chin-Song, No. Lin 7, Alley 6, Lane 180, Pin Chiang St., Taipei, Taiwan

[21] Appl. No.: 500,964

[22] Filed: Mar. 29, 1990

[51] Int. Cl.[5] ..... F21S 1/12

[52] U.S. Cl. ..... 362/418; 362/269; 362/285; 362/410; 362/413

[58] Field of Search ..... 362/269, 275, 285, 287, 362/401, 402, 410, 413, 414, 418, 419, 427, 457, 806

[56] References Cited

U.S. PATENT DOCUMENTS

| | | | |
|---|---|---|---|
| 1,474,304 | 11/1923 | Weber | 362/413 |
| 1,483,355 | 2/1924 | Kupsche | 362/413 |
| 2,060,660 | 11/1936 | Carpenter | 362/418 |
| 4,600,973 | 7/1986 | Mori | 362/419 |

*Primary Examiner*—Stephen F. Husar
*Assistant Examiner*—Hag200201Sue
*Attorney, Agent, or Firm*—Lowe, Price, LeBlanc, Becker & Shur

[57] ABSTRACT

A desk lamp, which comprises of a rod support connected to a stand through a spring, a toothed block and a swivel member to hold a lamp. The swivel member has a bottom projection set in an interrupted circular grooved on the top of the stand and confined to rotate within the range defined by the two stop edges of the two ends of the interrupted circular groove such that the lamp is confined to rotate horizontally within an angle less than 360°. The engaged position of the toothed block with the swivel member can be changed so as to simultaneously adjust the angular position of the lamp and the rod support relative to the stand.

2 Claims, 4 Drawing Sheets

DESK LAMP WITH IMPROVED ANGULAR POSITION ADJUSTING STRUCTURE

BACKGROUND OF THE INVENTION

The present invention is related to desk lamps and more particularly to a desk lamp which is pivotably secured to a stand by means of the engagement of a toothed block with a swivel member which can be rotated on such a stand within an angle less than 360°.

In regular desk lamps, the projecting angle of a lamp is generally adjusted by means of pivoted supporting arms or connecting rods.,i.e., the change of the angular position of a lamp is confined within the pivoting range of its pivoted supporting arms or connecting rods. The common disadvantage of this type of adjusting mechanism is the angular position adjusted can not be accurately controlled. It is therefore, the main object of the present invention to provide a desk lamp with improved angular position adjusting structure.

SUMMARY OF THE INVENTION

The present invention is to provide a desk lamp which is comprised of a rod support connected to a stand through a spring, a toothed block and a swivel member to hold a lamp. The swivel member has a bottom projection set in an interrupted circular groove on the top of the stand and confined to rotate within the range defined by the two stop edges of the two ends of the interrupted circular groove such that the lamp is confined to rotate horizontally with in an angle less than 360°. The engaged position of the toothed block with the swivel member can be changed so as to simultaneously adjust the angular position of the lamp and the rod support relative to the stand.

BRIEF DESCRIPTION OF THE DRAWINGS

The present invention will be described by way of example with reference to the annexed drawings, in which.

DETAILED DESCRIPTION OF THE PREFERRED EMBODIMENTS

Figure 1:
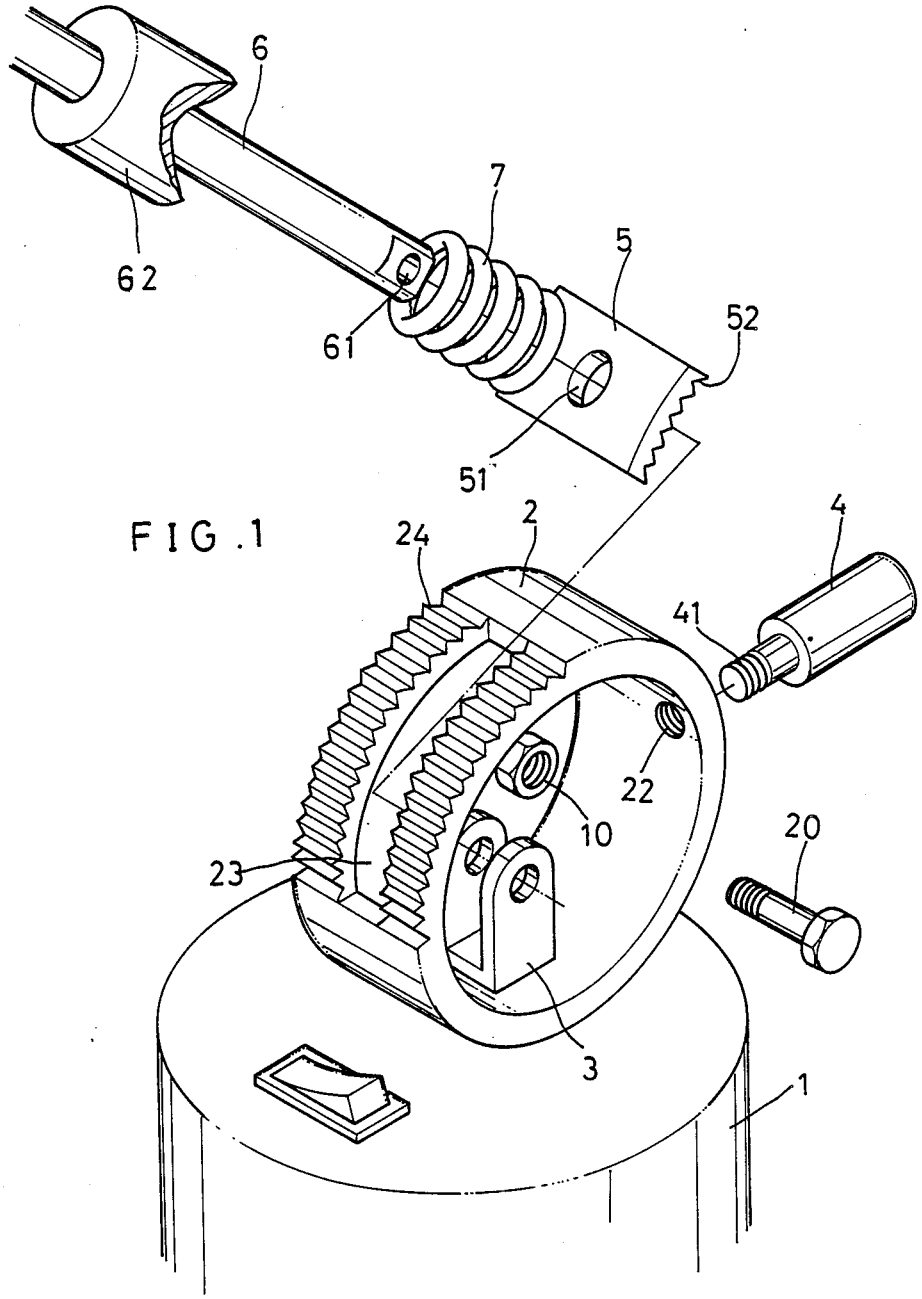
FIG. 1 is a perspective fragmentary view of present invention.
Figure 2:
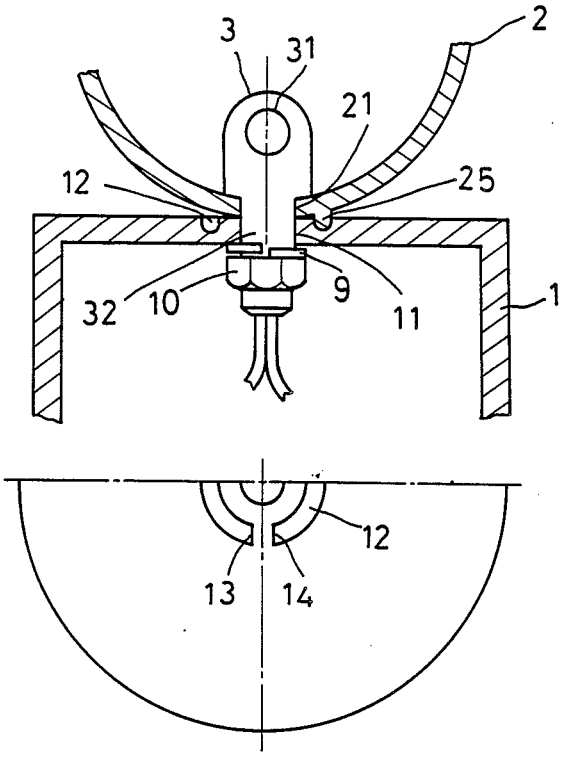
FIG. 2 is a sectional drawings illustrating the positioning of the swivel member on the stand and the arrangement of the interrupted circular groove on the stand thereof.
Figure 3:
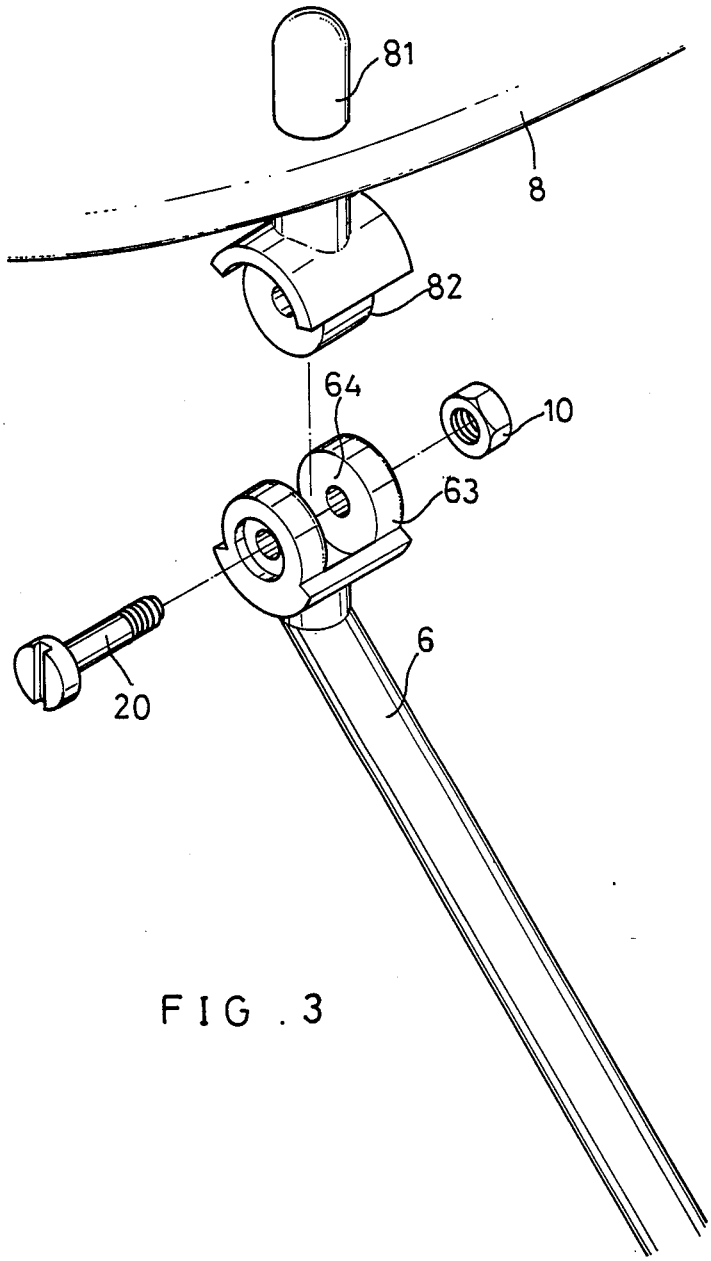
FIG. 3 is a partly perspective fragmentary view of the rod support and the lamp socket holder thereof.
Figure 4:
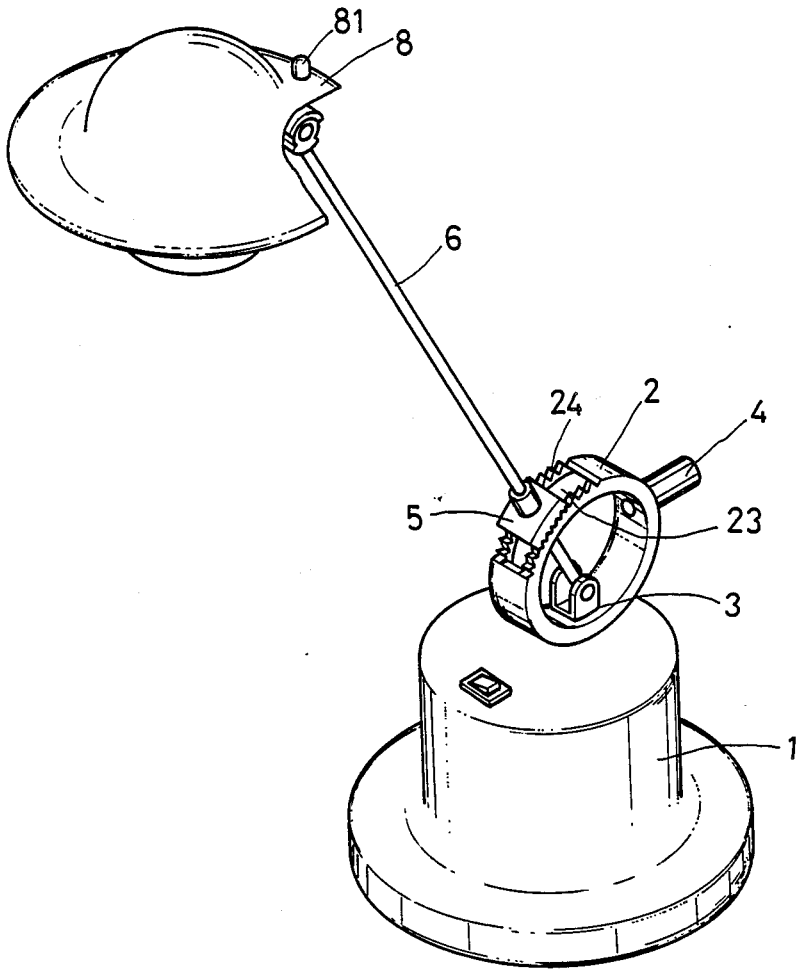
FIG. 4 is a perspective view of a desk lamp embodying the present invention.

Turning now to the annexed drawings in greater detail, therein illustrated is a desk lamp in accordance with the present invention and generally comprised of a stand 1, a swivel member 2, a fastening member 3, a hand-hold 4, a toothed block 5, a rod support 6, a spring 7 and a lamp socker holder 8.

The swivel member 2 has a ring-shaped body comprising a round hole 21 and a bottom projection 25 on the bottom, a bolt hole 22 at one side, an elongated slot 23 at an opposite side, and two rack portions 24 on both sides of its elongated slot 23.

The fastening member 3 comprises an upper U-shaped holder plate portion 31 and a bottom screw bolt portion 32. During assembly, the bottom screw bolt portion 32 of the fastening member 3 is inserted from the round hole 21 of the swivel member 2 into another round hole 11 on the stand 1 for the mounting thereon of a washer 9 and a lock nut 10 to secure the swivel member 2 to the stand 1 permitting the bottom projection 25 of the swivel member 2 to set in an interrupted circular groove 12 on the top of the stand 1.

The hand-hole 4 has a front screw bolt portion 41 fastened in the bolt hole 22 of the swivel member 2 for the holding thereon of the hand to drive the swivel member 2 to rotate.

The toothed block 5 is substantially in a curved structure having a round hole 51 in its center and two rack portions 52 bilaterally on its bottom surface. The toothed block 5 bridges over the elongated slot 23 of the swivel member 2 with its two rack portions 52 respectively engaged with the two rack portions 24 of the swivel member 2.

The rod support 6 comprises a mounting hole 61 on its lower end, a circular projection 62 above its mounting hole 61, and a holder plate 63 on the top defining therein a notch 64.

The spring 7 is sleeved on the rod support 6 and set between the toothed block 5 and the circular projection 62 of the rod support 6. After the spring 7 is sleeved on the rod support 6, the lower end of the rod support 6 is inserted through the elongated slot 23 of the swivel member 2 to secure to the U-shaped holder plate portion 31 of the fastening member 3 by means of a screw bolt 20 and a lock nut 10.

The lamp socket holder 8 comprises a vertical rod 81 having a transverse sleeve 82 on its bottom. During assembly, the transverse sleeve 82 is set in the notch 64 of the holder plate 63 of the rod support 6 and fixedly secured therein by a screw bolt 20 and a lock nut 10.

As soon as the aforesaid parts are respectively connected together, a desk lamp of the present invention is thus set up. By means of the positioning of the bottom projection 25 of the swivel member 2 in the interrupted circular groove 12 of the stand 1 and the pivoted connection of the swivel member 2 with the rod support 6, the swivel member 2 can be carried to rotate on the stand 1 within an angle less than 360° by means of the confinement of the two ends 13, 14 of the interrupted circular groove 12 which confine the moving range of the bottom projection 25 of the swivel member 2.

The angular position of the lamp socket holder 8 relative to the rod support 6 can be adjusted by means of rotating the transverse sleeve 82 of the vertical rod 81 within the notch 64 of the holder plate 63.

By means of the expansion force of the spring 7, the toothed block 5 is forced to constantly engage with the rack portions 24 of the swivel member 2. By means of charging the engaged position of the two rack portions 52 of the toothed block 5 with the two rack portions 24 of the swivel member 2, the angular position of the rod support 6 relative to the swivel member 2 can be adjusted within the rane of the elongated slot 23.

What is claimed:

1. A desk lamp, comprising:

a lamp stand having a round hole on the top through its central axis and an interrupted circular groove around said round hole, said interrupted circular groove having two stop edges at its both ends;

a swivel member having a ring-shaped body comprising a round hole and a bottom projection on its bottom, a bolt hole laterally on its outer face, an elongated slot laterally on its outer face opposite to said bolt hole, and two rack portions on its outer face at both sides of said elongated slot;

a hand-hold having a screw bolt portion fastened in the bolt hole of said swivel member;

a fastening member comprising an upper U-shaped holder plate position and a bottom screw bolt portion, said bottom screw bolt portion being inserted form the round hole of said swivel member into the round hole of said stand for the mounting thereon of a washer and a lock nut to secure said swivel member to said stand permitting the bottom projection of said swivel member to set in the interrupted circular groove of said stand;

a toothed block being substantially in a curved structure having a round hole in its center and two rack portions bilaterally on its bottom surface and movably engaged with the two rack portions of said swivel member; and a rod support comprising a circular projection and a mounting hole on its lower end, and a holder plate on its top end to hold a lamp socket holder for holding a lamp, the lower end of said rod support is inserted through a spring and the elongated slot of said swivel member to secure to the U-shaped holder plate portion of said fastening member by means of a screw bolt and a lock nut permitting said spring to be squeezed in between said toothed block and the circular projection of said rod support;

wherein the angular position of said rod support relative to said stand is adjusted by means of rotating said swivel member on said stand and changing the engaged position of said toothed block with said swivel member.

2. A desk lamp as claimed in claim 1, wherein the moving range of the bottom projection of said swivel member is confined within the two stop edges of said interrupted circular groove such that said swivel is confined to rotate on said stand within an angle less than 360°.

* * * * *